US008128176B2

(12) United States Patent
Klabisch et al.

(10) Patent No.: US 8,128,176 B2
(45) Date of Patent: Mar. 6, 2012

(54) DEVICE FOR DETERMINING THE CUTTING HORIZON OF A MINING EXTRACTION SYSTEM, AND PAN ELEMENT THEREFOR

(75) Inventors: Adam Klabisch, Dortmund (DE); Norbert Hesse, Bochum (DE); Klaus Duhnke, Werne (DE); Diedrich Bettermann, Unna (DE); Gerhard Siepenkort, Lünen (DE)

(73) Assignee: Bucyrus Europe GmbH, Lünen (DE)

( * ) Notice: Subject to any disclaimer, the term of this patent is extended or adjusted under 35 U.S.C. 154(b) by 331 days.

(21) Appl. No.: 12/597,612

(22) PCT Filed: Apr. 17, 2008

(86) PCT No.: PCT/EP2008/003086

§ 371 (c)(1), (2), (4) Date: Oct. 26, 2009

(87) PCT Pub. No.: WO2008/131867

PCT Pub. Date: Nov. 6, 2008

(65) Prior Publication Data

US 2010/0117439 A1 May 13, 2010

(30) Foreign Application Priority Data

Apr. 26, 2007 (DE) ..... 20 2007 006 122 U

(51) Int. Cl.
*E21C 35/12* (2006.01)

(52) U.S. Cl. ..... 299/1.1; 299/1.6

(58) Field of Classification Search ..... 299/1.1, 299/1.6, 1.7

See application file for complete search history.

(56) References Cited

U.S. PATENT DOCUMENTS 3,876,251 A * 4/1975 Boyd et al. ..... 299/1.1
5,553,925 A * 9/1996 Merten et al. ..... 299/1.1

FOREIGN PATENT DOCUMENTS

DE 3509868 A1 10/1985
DE 3841524 A1 6/1989
DE 4414578 A1 11/1995
DE 19925949 A1 12/2000

(Continued)

OTHER PUBLICATIONS

M Garrido Garcia, International Search Report for PCT/EP2008/003086; completed Sep. 24, 2008, mailed Oct. 2, 2008, 2 pages, European Patent Office, Rijswijk, The Netherlands.

(Continued)

*Primary Examiner* — John Kreck
(74) *Attorney, Agent, or Firm* — Rankin, Hill & Clark LLP

(57) ABSTRACT

The invention relates to a device for determining the cutting horizon of a mining winning system, having a movable conveyor which is composed of individual pan elements, and having at least one optical detection sensor which has a sensor head that is received in a sensor carrier and can be pressed with at least one pressure means against a coal/basement rock boundary layer. In order to improve the sensing and working reliability, over the length of the conveyor, a plurality of pan elements are configured as sensor pans which are provided with a protected recess which is open to the basement rock and in which the sensor carrier is arranged or can be arranged such that it can be disassembled together with the sensor head.

22 Claims, 4 Drawing Sheets

FOREIGN PATENT DOCUMENTS

WO WO 2008/131867 A1 11/2008

OTHER PUBLICATIONS

Authorized Officer Wittmann-Regis, Agnes, English translation of the PCT International Preliminary Report for PCT/EP2008/003086, date of mailing Nov. 5, 2009, 2 pages, The International Bureau of WIPO, 34, chemin des Colombettes, 1211 Geneva 20, Switzerland.

Authorized Officer Garrido-Garcia, M., English translation of the Written Opinion of the International Searching Authority for PCT/EP2008/003086, date of mailing Nov. 5, 2009, 5 pages, European Patent Office—P.B. 5818 Patentlaan 2, NL-2280 HV Rijswijk—Pays Bas, Netherlands.

* cited by examiner

DEVICE FOR DETERMINING THE CUTTING HORIZON OF A MINING EXTRACTION SYSTEM, AND PAN ELEMENT THEREFOR

This application claims priority to and the benefit of the filing date of International Application No. PCT/EP2008/003086, filed 17 Apr. 2008, which application claims priority to and the benefit of the filing date of German Application No. 20 2007 006 122.6, filed 26 Apr. 2007, both of which are hereby incorporated by reference into the specification of this application.

The invention relates to a device for determining the cutting horizon of a mining winning system, in particular a coal plough system, having a movable conveyor which is composed of individual pan elements which in each case have a conveyor pan having an upper run and a lower run, and a guide section with guide elements which is installed on the working face side as machine guide for an winning machine, and having at least one optical detection sensor for sensing the coal/basement rock boundary layer, which detection sensor has a sensor head which is received in a sensor carrier and can be pressed by at least one pressure means against the boundary layer which is to be sensed. The invention also relates to a pan element for a conveyor of a mining winning system, having a conveyor pan with an upper run and a lower run, and having a guide section which is installed on it on the working face side as machine guide for a winning machine, in particular for use in a device of this type.

BACKGROUND

Efforts have been made for a long time in underground mining to sense the boundary layer between the basement rock and the coal in running working operation, in order to adapt (cutting horizon setting) the underground winning system in as optimum a manner as possible, in accordance with the determined values for the boundary layer, to the profile of the coal layer above a rock layer which then forms the basement rock and is not to be extracted. In order to sense the boundary layer, optical detection sensors are usually used which have an optical sensor head and an optical window which is connected in front of the former, such as a sapphire window, in particular. By way of sensors in the sensor head, the different reflectance of basement rock and coal is utilized optically and fed as measured signal via optical waveguides to an optoelectrical converter and subsequently to an evaluation unit which calculates the profile of the boundary layer between basement rock and coal from the output signals.

In the detection systems for the profile of the basement rock/coal boundary layer which have previously usually been used in tests in underground mining, the optical detection sensor is installed into the mining winning system, with the result that there is permanently a measured signal for the current position of the mining winning machine by way of a detection sensor or optionally by way of two optical detection systems on the mining machine. A generic device of this type for a coal plough winning system is described in detail in DE 199 25 949 B1. The known detection sensor is arranged displaceably within a sensor carrier and is anchored as an exchangeable part in a recess in the plough body of the winning plough. The sensor head is biased in the direction of the basement rock by way of a compression spring, in order to ensure contact with the boundary layer which is to be sensed. Here, the sensor carrier is seated eccentrically with respect to the center axis of the plough body near one of the two pivotable tool carriers of the coal plough. The sensor head is equipped on the end side with a wearing shoe which is to protect the crystal window from destruction. However, it is shown during long-term operational use that the service life of the optical detection sensor is relatively low and the optical detection sensor has to be exchanged at the latest after two to three months. Experience during operational use shows that the service life decreases the stronger the pressing force of the sensor head by means of the compression springs onto the boundary layer which is to be sensed is selected to be, the more irregular the profile of the basement rock is on account of depressions or recesses, and the higher the plough speed is selected to be. Moreover, an eccentric arrangement of the optical detection sensor results in different loadings for the different planing directions.

In DE 44 14 578 C2, in order to determine the basement rock/coal boundary layer by means of optical detection sensors, the applicant has proposed not to transport the optical detection sensors with the winning system, but to integrate them into the front foot of the machine track of the machine guide, in order that the optical detection sensors are arranged permanently above the basement rock and can sense the boundary layer. The advantage of this substantially stationary arrangement of the optical detection sensors lies in considerably increased operational reliability on account of considerably lower loadings of the individual detection sensors. However, it is disadvantageous that only a small amount of installation space is available for the optical detection sensors on the machine track for the coal plough and the optical waveguides have to be laid in an unprotected manner at any rate partially on the underside of the machine track. Up to now, there has been no practical implementation of the arrangement of the detection sensors which is proposed in DE 44 14 578 C2.

SUMMARY OF INVENTION

One of the objects of the invention is to provide a device for determining the cutting horizon of a mining winning system and pan elements which are suitable for this purpose, which make reliable sensing of the coal/basement rock boundary layer possible with increased operational reliability and minimized susceptibility to wear.

According to the invention, this object is achieved in a corresponding device by virtue of the fact that, distributed over the length of the conveyor, a plurality of pan elements are configured as sensor pans which are provided with a protected recess which is open to the basement rock and in which a sensor carrier is arranged such that it can be disassembled together with the sensor head. Furthermore, in the device according to the invention, a sensor head is used which can be pressed by means of a pressure means against the boundary layer which is to be sensed, which sensor head is not assigned to the moved winning machine, as in the generic prior art, but is assigned in a stationary manner to a plurality of pan elements, distributed over the length of the conveyor, which as a result form sensor pans. Since substantially stationary optical detection sensors which are moved at most by the conveyor moving operation are used, the friction which acts on the optical window, such as, in particular, the sapphire window, and any wear on account of the pressing force onto the basement rock, which pressing force is applied by means of the pressure elements, are substantially lower than in optical detection sensors which are guided along with the winning machine. Furthermore, it is no longer required to install a radio transmission means between the moved optical detection sensor and the shields or the like, since the data transmission can take place without problems via wired transmission lines.

In order to supply sufficient information for the profile of the boundary layer between coal and basement rock despite the optical detection sensors which are arranged distributed over the length of the conveyor, every pan element of the conveyor, or optionally also every nth pan element, for example about every fifth to fifteenth, for example approximately every eighth to tenth pan element of the conveyor is configured as a sensor pan. Depending on the length of an individual pan, this then results in a spacing of from approximately 1.8 to 15 m or approximately 20 m between two optical detection sensors, with the result that, even if an optical detection sensor fails, sufficient information is available at a sensor pan to determine the basement rock profile reliably from the signals of the detection sensors and to provide it as control information for actuating the underground mining winning systems. The underground mining winning system can be actuated, in particular, via usually present actuating cylinders which adapt the working position of the winning machine to a changed basement rock level and therefore track the cutting horizon of the winning machine to the actual basement rock profile.

The above object is also achieved, in particular, by suitable pan elements which are configured as sensor pans and have a protected recess which is open to the basement rock for dismantlably receiving a sensor carrier for an optical detection sensor which can be pressed by means of at least one pressure means onto the boundary layer, for sensing the coal/rock boundary layer. In the particularly exemplary embodiment, the sensor carrier is arranged in a recess which is formed near the side profiles on the working face side of the upper run and the lower run. The sensor carrier is then at a small spacing from the working face, which spacing corresponds approximately to the necessary depth of the machine guide for guiding the winning machine which carries the cutting tools. The spacing, which is selected deliberately in the invention, of the position of the detection sensor from the foot of the machine guide considerably increases the available installation space for the recess, with the result that optical detection sensors which are considerably more wear-resistant and are at the same time provided with a pressure means can be used. In one advantageous embodiment, the recess can be formed in a side cheek on the working face side of the conveyor section or even more advantageously in a goaf-side connecting wall of the guide section. The arrangement of the recess and therefore also the sensor carrier including the sensor head in a connecting wall of the guide section can be realized particularly simply if the guide section comprises a cast part having an integral connecting wall which is of correspondingly strong configuration.

One of the uses of the device according to the invention or the pan elements according to the invention relates to plough systems, in which the machine guide is configured as a plough guide having chain channels for a chain belt for the winning plough and having a machine track for the winning plough, the recess then being arranged on the goaf side of the chain channels. The positioning of the optical detection sensors on the goaf side of the chain channels simplifies the maintenance considerably in comparison with all solutions which are known from the prior art, since the optical detection sensors can be disassembled or mounted without it being necessary for the machine track to be disassembled or for the miner to walk in front of the plough body. It is particularly advantageous for the maintenance and any possibly required mounting or dismantling if the recess extends in the conveyor section or the guide section from top to bottom and mounting/dismantling of the sensor carrier is made possible from the upper run of the conveyor.

In one advantageous embodiment, the recess can have a cylindrical cross section and/or the sensor carrier is configured as a cylindrical housing part which can be inserted into the recess and in the interior of which the pressure means is arranged and the sensor head is mounted such that it can be displaced by means of the pressure means.

Since sufficient overall height is available on a side wall or connecting wall between the conveyor and the machine guide, sensor carriers can then substantially still be used, as are described in DE 199 25 949 A1, reference being made to the disclosed contents of this document in this regard. In the corresponding embodiment, the mounting/disassembling opening for the recess for receiving the sensor carrier can be sealed or closed, in particular, by means of a dismantlable side profile piece for that side profile of the conveyor upper run which is on the working face side. A dismantlable side profile piece of short overall length can be anchored relatively simply as bridging piece to a pan element or the like by means of screw connections.

In an alternative embodiment, the sensor carrier can be arranged in a recess with an open edge on the underside of the guide or pan, the sensor carrier being mounted in this embodiment such that it can be displaced relative to the guide or pan by means of the at least one pressure means. In this embodiment, the sensor head is therefore no longer moved relative to the sensor carrier by means of the pressure means, but rather a sensor carrier of wear-resistant configuration is used, into which the sensor head is integrated fixedly, the entire sensor carrier being arranged movably in the recess together with the sensor head, in order to ensure at all times that the sensor head in the sensor carrier is pressed against the boundary layer which is to be sensed, independently of the profile of the basement rock. The recess for sensor carriers of this type can be formed, in particular, in the protected region on the goaf side of the connecting wall of the machine guide which is configured as a cast part. A corresponding machine guide can have, in particular, a connecting wall which forms at least partially a profile limb for scrapers in the lower run and has a welding point for a lower run base, the recess for the detection sensor then being formed below the lower run base and on the goaf side of the connecting wall. Corresponding pan elements can have a support rib, in particular below the lower run base, on which support rib the sensor carrier is then mounted displaceably. At the same time, the support ribs can form a lateral shield for the movable sensor carrier, in particular if the sensor carrier is arranged between two support ribs.

Sensor electronics for optoelectronic signal conversion can be arranged directly in the recess. As an alternative, sensor electronics can be arranged on the goaf-side side wall of the pan elements, it then being particularly advantageous if an optical connecting cable such as, in particular, an optical waveguide or an optical waveguide bundle is laid in the intermediate bottom between the upper run and the lower run. If the sensor carrier is at the same time equipped with sensor electronics and is arranged together with the latter in the recess, an electrical connecting cable can be laid as an alternative in the intermediate bottom between the upper run and the lower run, in order to ensure the electrical supply and the signal feeding between an winning or longwall face controller and the optical detection sensors.

According to the present invention, the pressure means can comprise at least one spring. In a sensor carrier which is configured as a cylindrical housing part, the spring can be positioned within the housing part and can press the sensor head relative to the housing in the direction of the boundary layer which is to be sensed. In a sensor carrier which can be moved within the recess, a plurality of compression springs are used. An optical window, in particular a sapphire window, is connected in front of the sensor head. Since the entire mining winning system is moved by the cutting depth after each pass of the winning machine, the sensor head or, in particular, the optical window is assigned a guard strip. This guard strip can be configured, in particular, as a generally V-shaped guard strip, the tip of which points in the direction of movement, with the result that even rocks which are lying around cannot damage the optical window during the moving operation. In order to ensure after each moving operation that the reflectance of the boundary layer can be sensed without disruptions, a pneumatic feed means, in particular a compressed air feed means, can be installed according to a more advantageous embodiment, in order to optionally clean the optical window in the sensor pans according to the invention. The pneumatic feed means can open, for example, into a nozzle which is assigned to the optical window and blows the optical window free during the moving operation. As an alternative or in addition, an actuable lifting means which counteracts the pressing force of the pressure means can be provided for optionally lifting the sensor head or sensor carrier. The lifting means can then also be actuated pneumatically, in order, for example during the moving operation, as an additional protective measure for the sensor head, to press the latter or the sensor carrier into the recess, and to press it onto the boundary layer via the pressure means only after the moving operation has finished. However, the lifting means could also be actuated electromagnetically.

Further advantages and refinements of the invention result from the following description of exemplary embodiments which are shown diagrammatically in the drawing.

DETAILED DESCRIPTION

Figure 1:
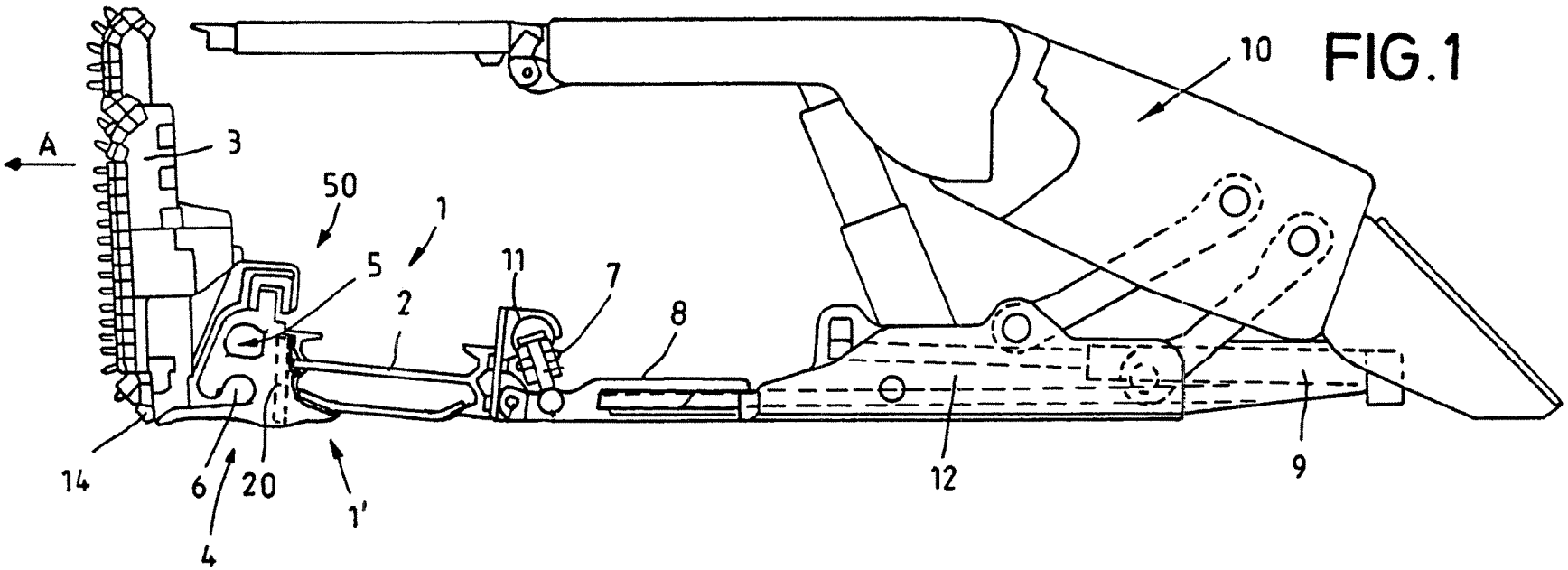
FIG. 1 shows, diagrammatically in cross section through an winning face, a plough system according to the invention having a sensor pan and a jib controller for setting the cutting horizon of the plough.

Referring now to the drawings wherein the showings are for the purpose of illustrating exemplary embodiments of the invention only and not for the purpose of limiting same, the plough system, which is shown diagrammatically in FIG. 1 and the basic design of which is known, comprises a face conveyor 1 which is laid in front of a coal face (not shown) and can be moved in the working direction, in the form of an armored flexible conveyor, of which only one pan element 1' is shown in FIG. 1. A coal plough 3 which loads the coal which is extracted at the working face in a stripping manner into the face conveyor 1 is guided on the conveyor 1 as winning machine. The correspondingly extracted coal can be conveyed away from the winning operation by way of the face conveyor 1. The coal plough 3 is guided positively on a plough guide or machine guide which is installed as guide section 4 on the working face side in each case on the pan 2 of each pan element 1' of the face conveyor 1. The to and fro movement of the coal plough 3 is applied by means of a plough chain which is laid within chain channels 5, 6 within the guide section 4 which forms the machine guide, the coal plough 3 being connected to the plough chain in the lower chain channel 6, as is known to a person skilled in the art of mining.

For controlling the horizon or level of the plough system which comprises the face conveyor 1, the coal plough 3 and the plough guide, every pan element 1' of the conveyor 1 or every second pan element 1' of the conveyor 1 is provided with a hydraulic actuating cylinder 7 which is arranged obliquely with respect to the basement rock and is mounted by way of one end on the head piece 8 of a walking type travel gear 9 and by way of its other end in an articulation head 11 on the pan element 1'. The walking type travel gear 9 in turn lies between basement rock floor members 12 of a shield support frame 10, by way of which the working face is kept open and the automatic moving of the winning system can be performed. The cutting horizon of the coal plough 3 which forms the winning machine can be adjusted by extension or retraction of the actuating cylinder 7, the cutting horizon being set in the optimum case in such a way that the bottom blades 14 of the coal plough 3 cut relatively precisely at the boundary layer between the basement rock which is not to be extracted and the coal which is to be removed.

In FIG. 1, the designation 20 diagrammatically indicates an optical detection sensor which is arranged in a recess in the connecting wall of the guide section 4 on the goaf side of the chain channels 5, 6 and by way of which the boundary layer between the basement rock and the coal can be sensed on the underside of the guide section 4. Distributed over the length of the winning system, each pan element or each machine guide can be provided with a corresponding optical detection sensor 20. However, it can optionally be sufficient not to provide each pan element or each machine guide with a corresponding optical detection sensor 20, but rather to configure only approximately every fifth to tenth pan as a sensor pan 50 having an integrated or associated optical detection sensor 20. The measured data which are sensed by the optical detection sensors 20 and are converted into electrical signals via converters (not shown) can be transmitted via optical waveguides and electrical cables to an electronic evaluation and control unit (not shown), to the winning control unit of the associated shield 10 or to a central controller, in order to generate control signals for the control cylinders 7 from the measured signals, as a result of which the cutting horizon of the coal plough 3 can be adapted to the profile of the basement rock/coal boundary layer. Since the profile of the coal seam does not change abruptly in the majority of cases, sensing of the basement rock/coal boundary layer and level control of the cutting horizon can still be carried out sufficiently close to real time by way of the optical detection sensors 20 which are arranged offset to the working face by approximately the width of the machine guide (guide section 4).

Figure 2:
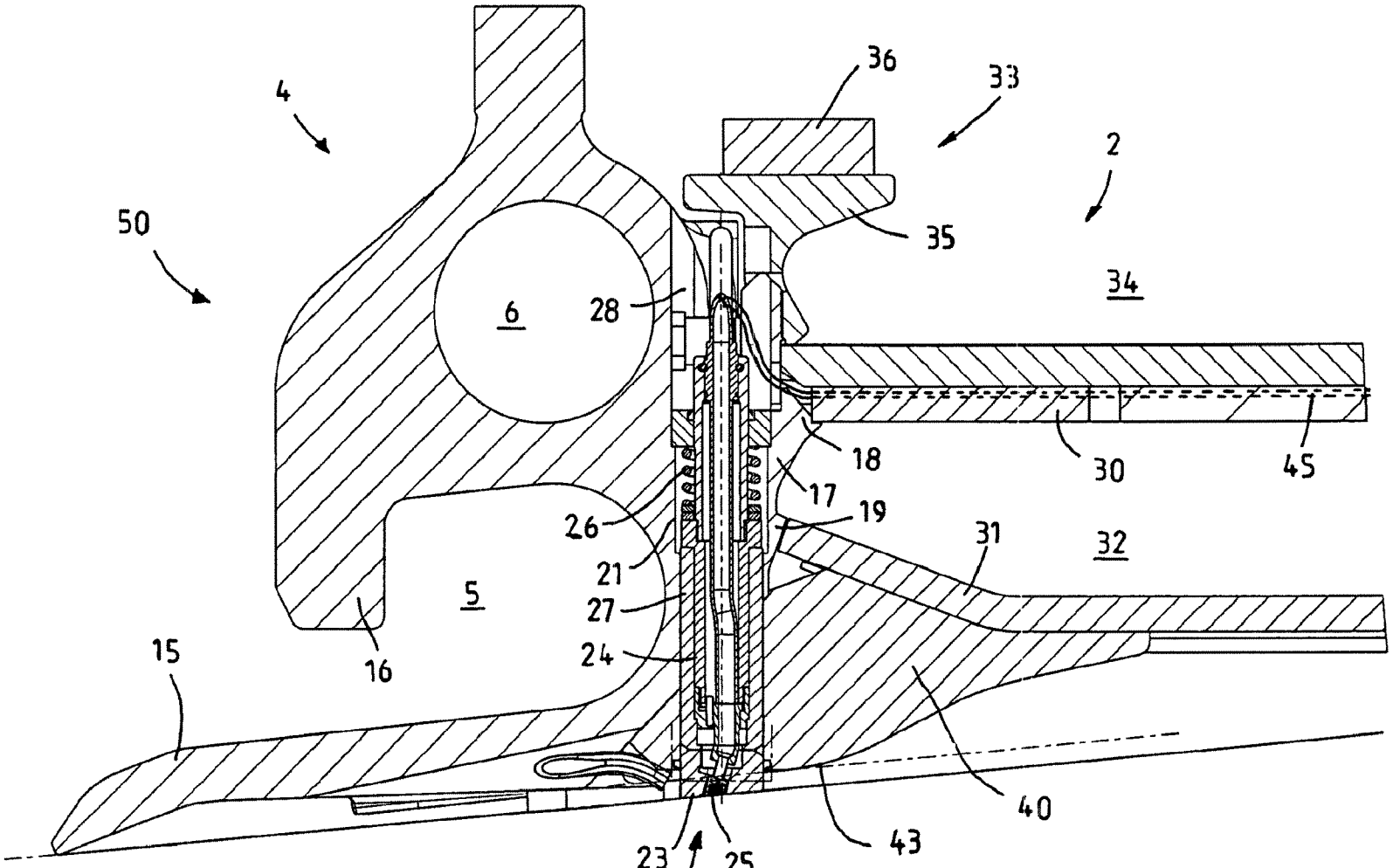
FIG. 2 shows a vertical section through the end, on the working face side, of a sensor pan according to the invention in accordance with a first exemplary embodiment.

Reference is now made to FIG. 2, in which that end of a conveying pan 2 which is on the working face side is shown in detail with an attached machine guide section 4 having a vertically oriented recess 21 for receiving the optical detection sensor 20. In the exemplary embodiment which is shown, the machine guide section 4 comprises substantially a body which is configured as a cast part with integral chain guide channels 5, 6, an integrally formed machine track 15, a guide projection 16 for a chain block which dips into the lower chain channel 5 to engage behind, and a strong, goaf-side connecting wall 17, on which both a welding lug 18 for an intermediate bottom 30 and a welding lug 19 for a lower run bottom 31 are arranged integrally. The intermediate bottom 30 separates the lower run 32 of the conveyor section 2 from its upper run 34 which is configured here as a detachable trough 33. The upper opening of the recess 21 is arranged in such a way that it opens substantially below the side profile 35, which is on the working face side, of the detachable trough 33 which comprises the upper run 34. The detection sensor 20 can be inserted as a single piece exchangeable part from above into the recess 21. For mounting/dismantling, either the detachable trough 33 has to be dismantled completely or the side profile 35 which is on the working face side is configured in multiple pieces and is provided with an intermediate piece which can be screwed via a cover strip 36 and screw connections to side profile pieces which are arranged fixedly on the detachable trough 33 or upper run 34. The optical detection sensor 20 can therefore be disassembled at the top without problems, without it being necessary for the corresponding sensor pan 50 to be disassembled from the conveyor or lifted. The recess 21 is open by means of an opening to the basement rock on the underside 23 of the machine guide section 4 or, as shown, to the underside 23 of a support rib 40 which is welded on in the lower region of the connecting wall 17. A wearing shoe 23 of an optical sensor head 24 of the detection sensor 20 protrudes through the opening. The wearing shoe 23 of the sensor head 24 is provided centrally with an optical window (sapphire window) 25, through which the reflectance of the basement rock, on which the winning system rests by way of the support rib 40 and the machine track 15, can be sensed. Here, the sensor head 24 is prestressed by means of a compression spring 26 in the direction toward the basement rock, in order that the optical window 25 itself then rests on the basement rock if, for example, the underside 43 of the support rib 40 is at a small spacing from the basement rock, as indicated by the two dash dotted lines in FIG. 2. Here, the sensor head 24 and the compression spring 26 are arranged in a cylindrical housing part 27 which is inserted from above into the likewise cylindrical recess 21 and is anchored, for example, on a step of the recess 21.

In the exemplary embodiment in FIG. 2, the optical signals of the sensor head 24 are fed via an optical waveguide 45 to an optoelectrical converter (not shown), the optical waveguide 45 which is optionally configured as an optical waveguide bundle being laid in a protected manner in the intermediate bottom 30 between the lower run 32 and the upper run 34 or detachable trough 33. However, the optoelectrical converter or sensor electronics could also be arranged as an integral constituent part of the optical detection sensor 20 in the recess 21 or within the relatively large clearance 28 above the recess 21, in order to transmit exclusively electrical signals between the position of the detection sensor 20 and remotely arranged evaluation electronics or the like. The current supply for all the components which are required in the optical detection sensor 20 could then be realized immediately via the connecting cables. FIG. 2 shows a position of the sensor head 24 of the optical detection sensor 20, in which the optical window 25 protrudes to the bottom beyond the underside 43. It goes without saying that the optical window 25 terminates flushly with the underside 43, on account of the movability which is ensured by way of the compression spring 26, if the underside 43 of the support rib 40 rests flatly on the basement rock.

Figure 3:
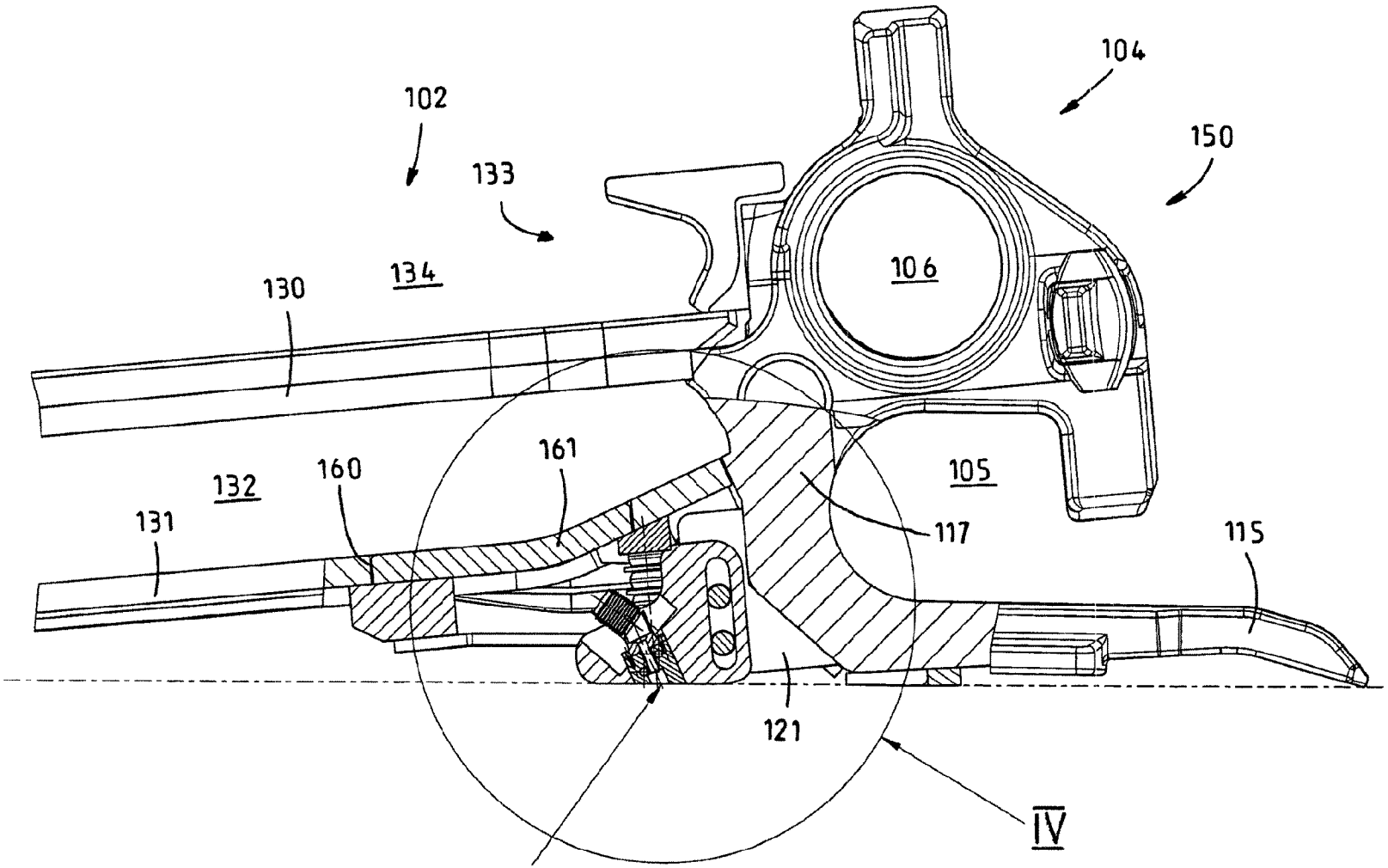
FIG. 3 shows a vertical section through the end, on the working face side, of a sensor pan in accordance with a second exemplary embodiment.
Figure 4:
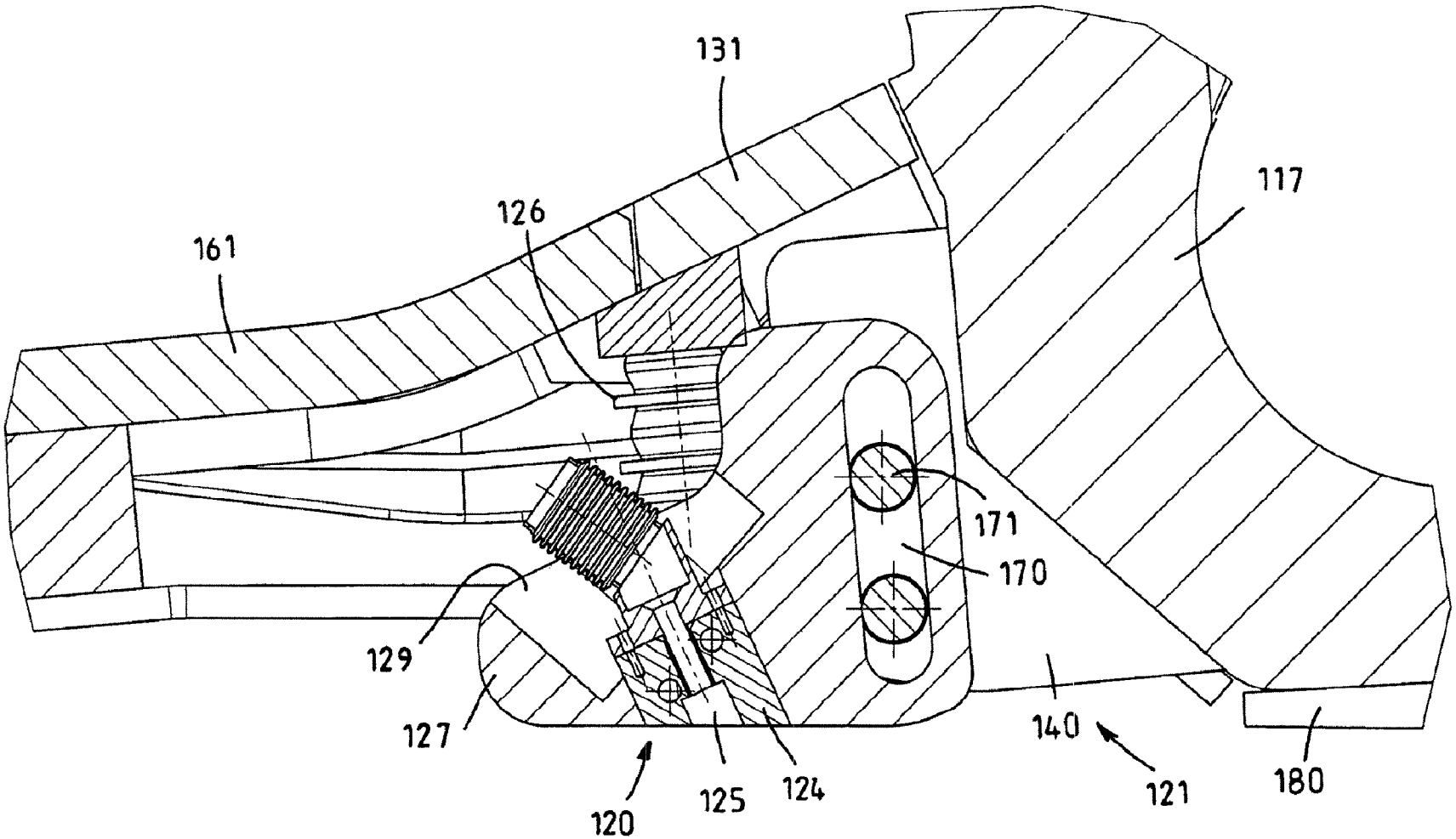
FIG. 4 shows a detail view of IV in FIG. 3.

FIGS. 3 and 4 show a second exemplary embodiment of a sensor pan 160 having a protected recess 121 and an arranged optical sensor 120. Here too, the sensor pan 150 has a pan 102 with a guide section 104 which is attached on the working face side and is configured substantially as a cast part with an integrally cast machine track 115, integrally configured chain channels 105, 106 and a strong connecting wall 117 which lies on the goaf side of the chain channels 105, 106. The upper run 134 of the conveyor is in turn configured as a detachable trough 133 which is supported on an intermediate bottom 130 which is welded to the connecting wall 117. An end, which is on the working face side, of a lower run bottom 131 is also welded to the connecting wall 117 which partially forms the lateral guide for scrapers in the lower run 132, which end, as in the previous exemplary embodiment, has upwardly angled away corner edges, in order to make clean guidance of the scrapers possible in the lower run 132. However, close to the end which is on the working face side, the lower run bottom 131 is provided partially with a bottom cutout 160 which is closed by means of a lower run bottom piece 161, in order for it to be possible for maintenance work to be performed, when the upper trough 133 and lower run bottom piece 161 are removed, on an optical detection sensor 120 which is arranged in a recess 121 which extends on the goaf side of the connecting wall 117 of integral configuration with the machine track 115 and below the lower run bottom 131. The recess 121 is also open at the bottom, but is protected in the moving direction or working direction of the sensor pans 150 by the machine track 115 and the corresponding limb section of the connecting wall 117. In turn, support ribs can be welded to the connecting wall 117 laterally of the recess 121, as is shown by way of example with the support rib 140 in FIG. 4, to which reference is now made.

In the optical detection sensor 120, the sensor head 124 with the optical window 125 is installed fixedly into a sensor carrier 127 which is configured here as a strong wearing shoe and is mounted such that it can be displaced relative to the connecting wall 117 and to the lower run bottom 131. For this purpose, the sensor carrier 127 has, laterally, a vertically oriented guide cutout 170, through which two guide pins 171 engage which are anchored, for example, on the support rib 140. A plurality of compression springs 126 which are supported for this purpose on the underside of the lower run bottom 131 press against the upper or rear side 129 of the sensor carrier 127. The entire sensor carrier 127 together with the sensor head 124 which is arranged in a protected manner within the sensor carrier 127 therefore moves downward as a result of the compression springs 126 if the underside of the machine track 115 or a V-shaped guard strip 180 which is fastened there and points with its tip in the working direction should be spaced apart from the basement rock, and is pressed reliably against the basement rock, in order that the optical system in the detection sensor 120 can sense the reflectance of the basement rock or the coal and deliver the measured signals to a control unit. Since there is a relatively large amount of clearance available, in particular, in the region behind the connecting wall 117 and below the lower run bottom 130, the entire sensor electronics including the optoelectrical converter can optionally be arranged within this recess 121. It is then sufficient to route a connecting cable either along the underside of the lower run bottom or once again via the intermediate bottom 130 to the goaf side and from there, for example, to the electronic control units of the individual winning shields.

It is not shown in the figures that a pneumatic feed means or compressed air feed means having a nozzle can be routed in each case to the recesses within the sensor pans, in order to blow the optical window in the sensor head free with compressed air if need be during the moving operation if the sensor pan is lifted briefly from the basement rock. Furthermore, it is not shown that a lifting apparatus can also be actuated, in particular, via the same pressure medium feed means, which lifting apparatus lifts the sensor head or sensor carrier counter to the force direction of the compression springs, with the result that no damage or wear to the optical window can occur even during the moving operation as a result of rocks or the like which are lying around. The lifting means could even be used for raising the sensor carrier or the sensor head briefly during running operation when the sensor pan rests on the basement rock, in order to clean the sapphire window or optical window with compressed air in this position.

The invention is not restricted to the exemplary embodiments which are shown. In particular for design of the machine guide including the design of the connecting wall, numerous modifications result, as is known to a person skilled in the art of underground mining for different designs of machine guides, plough bodies, chain geometries, etc. Depending on the length of the individual pan elements and as a function of the desired information density, every pan element or only every nth pan element can be configured as a sensor pan. The spacing between two conveying pans which are configured as sensor pans can also vary.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A device for determining a cutting horizon of an associated mining winning system comprising:

a movable conveyor including individual pan elements, each pan element having a conveyor pan having an upper run and a lower run, and a guide section installed on a working face side of the conveyor pan as a machine guide for an associated winning machine, and at least one optical detection sensor having a sensor head which is received in a sensor carrier and can be pressed by at least one pressure means against an associated coal/basement rock boundary layer which is to be sensed, wherein, the individual pan elements are distributed over a length of the conveyor, at least one pan element is configured as a sensor pan which is provided with a protected recess in the pan which is open to the associated basement rock and in which the sensor carrier is arranged such that the sensor carrier can be disassembled together with the sensor head.

2. The device as claimed in claim 1, wherein every pan element of the conveyor is configured as a sensor pan.

3. A pan element for a conveyor of a mining winning system, comprising:

a conveyor pan with an upper run and a lower run, a guide section installed on a working face side of the conveyor pan as a machine guide for an associated winning machine, and a protected recess in the pan open to an associated basement rock for dismantlably receiving a sensor carrier for an optical detection sensor which can be pressed by at least one pressure means onto an associated boundary layer which is to be sensed, for sensing the associated coal/rock boundary layer.

4. The pan element as claimed in claim 3, wherein the sensor carrier is arranged in the recess which is formed near a side profile on the working face side of the upper run and the lower run.

5. The pan element as claimed in claim 3, wherein the recess is formed in one of a side cheek on the working face side of the conveyor pan and a goaf-side connecting wall of the guide section.

6. The pan element as claimed in claim 5, wherein the guide section is configured as a plough guide having chain channels and having a machine track, and the recess being arranged on the goaf-side of the chain channels.

7. The pan element as claimed in any of claim 3, wherein the recess extends in one of the conveyor pan and the guide section from top to bottom and mounting/dismantling of the sensor carrier is from the upper run of the conveyor pan.

8. The pan element as claimed in claim 7, wherein the recess comprises a generally cylindrical cross section and the sensor carrier is configured as a generally cylindrical housing part being insertable into the recess and in the interior of which the pressure means is arranged and the sensor head is mounted displaceable by means of the pressure means.

9. The pan element as claimed in claim 7, wherein an opening for the mounting/disassembling of the sensor carrier is one of sealed and closed by a dismountable side profile piece arranged for that side profile of the conveyor pan upper run which is on the working face side of the conveyor pan.

10. The pan element as claimed in claim 3, wherein the sensor carrier is arranged in the recess with an open edge on the underside of one of the guide section and conveyor pan, the sensor carrier being displaceable relative to one of the guide section and conveyor pan by the at least one pressure means.

11. The pan element as claimed in claim 10, wherein a connecting wall of the guide section forms at least partially a profile limb for scrapers in the lower run and comprises a welding point for a lower run base, and wherein the recess for the detection sensor is formed below the lower run base and on a goaf-side of the connecting wall.

12. The pan element as claimed in claim 11, wherein the conveyor pan comprises a support rib below the lower run base, on which support rib the sensor carrier is mounted displaceably.

13. The pan element as claimed in claim 3, wherein sensor electronics for optoelectronic signal conversion are arranged directly in the recess.

14. The device as claimed in claim 1, wherein sensor electronics are arranged on a goaf-side side wall of the pan elements, and an optical connecting cable is laid between the upper run and the lower run.

15. The device as claimed in claim 1, wherein the pressure means consists of at least one spring.

16. The device as claimed in claim 1, wherein an optical window is connected with the sensor head.

17. The device as claimed in claim 16, wherein one of the sensor head and the optical window is assigned a guard strip which points in the direction of movement.

18. The device as claimed in claim 16, further including a pneumatic feed means for an cleaning of the optical window.

19. The device as claimed in claim 1, further including an actuable lifting means which counteracts the pressing force of the pressure means for optionally lifting one of the sensor head and sensor carrier.

20. The device as claimed in claim 1, wherein every nth pan element of the conveyor is configured as a sensor pan.

21. The device as claimed in claim 20, wherein approximately every fifth to fifteenth pan element of the conveyor is configured as a sensor pan.

22. The device as claimed in claim 20, wherein approximately every eighth to tenth pan element of the conveyor is configured as a sensor pan.

* * * * *